US009239550B2

(12) United States Patent
Hatano

(10) Patent No.: US 9,239,550 B2
(45) Date of Patent: Jan. 19, 2016

(54) IMAGE FORMING APPARATUS WITH ADJUSTING BELT UNIT

(71) Applicant: CANON KABUSHIKI KAISHA, Tokyo (JP)

(72) Inventor: Fukashi Hatano, Abiko (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 13/905,263

(22) Filed: May 30, 2013

(65) Prior Publication Data

US 2013/0322934 A1 Dec. 5, 2013

(30) Foreign Application Priority Data

Jun. 1, 2012 (JP) ..... 2012-125678

(51) Int. Cl.
*G03G 15/01* (2006.01)
*G03G 15/16* (2006.01)

(52) U.S. Cl.
CPC .. *G03G 15/1615* (2013.01); *G03G 2215/00143* (2013.01); *G03G 2215/00156* (2013.01); *G03G 2215/0132* (2013.01)

(58) Field of Classification Search
CPC ..... G03G 15/01; G03G 15/1615; G03G 2215/0132; G03G 2215/00156; G03G 2215/00143; G03G 2221/1654
USPC ..... 399/302
See application file for complete search history.

(56) References Cited

U.S. PATENT DOCUMENTS

| | | | | |
|---|---|---|---|---|
| 4,364,656 | A * | 12/1982 | Yanagawa | 399/92 |
| 4,551,001 | A * | 11/1985 | Yokota | 399/116 |
| 4,657,372 | A * | 4/1987 | Ikeda et al. | 399/13 |
| 7,239,828 | B2 | 7/2007 | Ito | |
| 7,257,351 | B2 * | 8/2007 | Tachiki et al. | 399/121 |
| 7,379,690 | B2 | 5/2008 | Ito | |
| 7,389,068 | B2 | 6/2008 | Ito | |
| 8,238,800 | B2 | 8/2012 | Hatano | |
| 2001/0022903 | A1 * | 9/2001 | Shirasawa et al. | 399/116 |
| 2005/0063732 | A1 | 3/2005 | Ito | |
| 2005/0074259 | A1 * | 4/2005 | Tachiki et al. | 399/121 |
| 2005/0078991 | A1 * | 4/2005 | Kimura et al. | 399/350 |
| 2005/0084291 | A1 * | 4/2005 | Kyung et al. | 399/121 |
| 2005/0095018 | A1 * | 5/2005 | Ahn et al. | 399/13 |
| 2006/0067745 | A1 * | 3/2006 | Yamada et al. | 399/302 |

(Continued)

FOREIGN PATENT DOCUMENTS

JP 2005-92153 A 4/2005

*Primary Examiner* — G. M. Hyder
(74) *Attorney, Agent, or Firm* — Fitzpatrick, Cella, Harper & Scinto

(57) ABSTRACT

An image forming apparatus assembly includes a main body, and a belt unit mounted to the main body and including an endless belt, a plurality of rollers including a first roller configured to apply a driving force to the belt and to stretch the belt, and a second roller around which the belt is wound with a wrapping angle not less than 90° and configured to stretch the belt, a frame configured to integrally support the rollers, a first engaging portion disposed in the frame and configured to position the first roller to the main body, and a second engaging portion disposed in the frame and configured to position the second roller to the main body. In addition, a guide member is configured to guide the belt unit and disposed in the main body, and including a first engaged portion engaged with the first engaging portion and a second engaged portion engaged with the second engaging portion.

12 Claims, 10 Drawing Sheets

(56) References Cited

U.S. PATENT DOCUMENTS

| | | | | |
|---|---|---|---|---|
| 2006/0067746 | A1* | 3/2006 | Okazaki | 399/302 |
| 2006/0140673 | A1* | 6/2006 | Kamimura et al. | 399/119 |
| 2007/0127955 | A1* | 6/2007 | Katoh et al. | 399/302 |
| 2007/0196142 | A1* | 8/2007 | Kaiho | 399/302 |
| 2007/0223967 | A1 | 9/2007 | Ito | |
| 2007/0225095 | A1 | 9/2007 | Ito | |
| 2009/0154957 | A1* | 6/2009 | Furuya | 399/121 |
| 2009/0304426 | A1* | 12/2009 | Nakagaki | 399/400 |
| 2011/0064464 | A1* | 3/2011 | Ju et al. | 399/121 |
| 2011/0110685 | A1* | 5/2011 | Sato et al. | 399/121 |

* cited by examiner (a)

(b)

(c)

(a)

(b)

(c)

(a)

(b)

(a)

(b)

(a)

(b)

(a)

(b)

IMAGE FORMING APPARATUS WITH ADJUSTING BELT UNIT

FIELD OF THE INVENTION AND RELATED ART

There are various types of image forming apparatuses which use an electrophotographic image forming method, an electrostatic recording method, or the like, to form an image. Some of them are widely in use as a printer, or a copying machine. They use a photosensitive drum (or photosensitive drums) as their image bearing member(s). They are also provided with such processing means as a charging means, an exposing means, and a developing means, which are disposed in the adjacencies of the peripheral surface of the photosensitive drum. Further, they are provided with an image transfer mechanism, a recording medium conveyance mechanism, an image fixing mechanism, etc.

Further, some of them employ an intermediary transfer member for transferring a toner image on a photosensitive drum onto recording medium. Among them, some have an endless intermediary transfer belt and/or an endless recording medium conveyance belt. The endless intermediary transfer belt temporarily holds a toner image after the transfer of a toner image onto the intermediary transfer belt from a photosensitive drum. The recording medium conveyance belt is an endless belt which conveys recording medium onto which a toner image is transferred from a photosensitive drum.

An image forming apparatus which is equipped with an endless belt such as those described above has to be provided with a means for preventing a problem peculiar to a system which uses an endless belt, more specifically, the problem that as the endless belt is circularly moved, it tends to laterally shift. As for the method for preventing an endless belt from laterally shifting, there have been used the following three methods (1)-(3), for example.

(1) Ordinarily, a system which employs an endless belt is structured so that the endless belt is suspended by multiple rollers, which include a belt driving roller (which hereafter may be referred to simply as driver roller). Thus, as the endless belt is circularly moved, the belt tends to shift toward one of the lengthwise ends of the driver roller, for example, which is smaller in diameter than the other lengthwise end. This property of the system is utilized to control the lateral shifting of the endless belt. That is, one (or more) of the rollers by which the endless belt is suspended is shaped so that its center portion is largest in diameter and the roller gradually reduces in diameter toward its lengthwise ends. With the provision of this setup, the endless belt is likely to remain centered relative to the roller in terms of the direction (widthwise direction of endless belt) which is roughly perpendicular to the direction in which the endless belt is circularly moved.

(2) The process for manufacturing a system which employs an endless belt is strictly controlled in terms of the preciseness of each roller of the system, and the level of parallelism among the rollers. Further, the endless belt is provided with a rib (or ribs) which extends in the circumferential direction of the endless belt, and also, the system is provided with a member with which the rib comes into contact as the belt shifts in the direction which is roughly perpendicular to the direction in which the belt is circularly moved.

(3) The process for manufacturing the endless driving belt driving system is strictly controlled in terms of the preciseness of each roller, and the endless belt is provided with the rib for controlling the lateral shifting of the endless belt. Further, the amount by which the endless belt laterally shifts is measured during the process of assembling the endless belt driving system, and the rollers are adjusted in terms of the level of parallelism at which they are arranged.

However, the three methods described above have the following problems. That is, in the case of a method such as the method (1), which tries to keep an endless belt centered by shaping an endless belt supporting roller so that the center portion of the roller is largest in diameter, the portions of the belt which are supported by the portions of the roller, which are smaller in diameter than the center portion, slacken, and/or the belt fails to be properly centered, unless the endless belt is elastic enough to conform to the shape of the belt supporting roller. Further, if the endless belt is extremely thin, the endless belt is likely to be overcome by the force which tends to cause the endless belt to converge toward its center. Consequently, the center portion of the belt wrinkles.

Further, in the case of the method such as the method (2) which strictly controls the process of manufacturing the belt supporting rollers, in terms of the preciseness of each roller, and regulating the lateral movement of the endless belt, by providing the endless belt with a rib or ribs, the following problems sometimes occurred. That is, the force which acts in the direction to cause the endless belt to laterally shift cannot be ignored without having a negative effect. More specifically, as the endless belt is circularly moved while being controlled in its lateral shift, stress accumulates in the rib of the endless belt, which sometimes caused the rib to jump the rib regulating member, which sometimes caused the endless belt itself and/or its rib to break. Further, the high level of precision of which the process of manufacturing the endless belt driving system is required increases in cost the components of the endless belt supporting system.

Further, even after the amount by which the endless belt tends to laterally shift is measured after the assembly of the belt supporting system (device), and the belt supporting rollers are aligned to cancel the tendency of the endless belt to laterally shift, as in the case of the method (3) described above, the following problem sometimes occurred. That is, if an endless belt supporting system (mechanism) is not exactly in the same condition as that in which it was when it was assembled, that is, if it becomes distorted, its endless belt laterally shifts, causing eventually the belt to shift far enough for the rib to creep onto the rib regulating member. As the belt creeps onto the rib regulating member, it is possible for the endless belt and/or its rib (ribs) to become damaged. Thus, even if the endless belt supporting device is adjusted after it is installed in the main assembly of an image forming apparatus, for example, the endless belt begins to laterally shift because of the frictional wear of the rollers, changes in the amount of friction between the endless belt and rollers attributable to the surface deterioration of the belt and rollers, stretching of the belt, and/or the like causes. Consequently, the rib creeps onto the rib regulating member, which will result in damage to the rib itself and/or the belt.

Thus, various inventions have been made to deal with this problem. One of such inventions is disclosed in Japanese Laid-open Patent Application 2005-92153. According to this patent application, an image forming apparatus is provided with a platen roller as one of the rollers by which an endless belt is suspended, a belt driving roller which can be changed in its angle relative to the platen roller, and another roller which can be placed in contact with, or separated from, the endless belt. The apparatus is changed in the state of contact between its belt contacting member and endless belt so that the angle of the belt driving roller relative to the platen roller changes in response to the change in the state of contact between the belt contacting roller and endless belt.

The art disclosed in Japanese Laid-open Patent Application 2005-92153, however, is possibly problematic in that as the transferring means frame, by which the belt supporting rollers are supported, progressively distorts, the rollers become progressively misaligned among themselves. Eventually, the misalignment becomes too much to be dealt with. Further, in the case of an image forming apparatus, the belt cleaning member of which is positioned in such a manner that it is pressed against the belt driving roller (belt steering roller), with the presence of the belt between the belt cleaning member and the belt driving roller, the belt cleaning member becomes unstable in the state of contact between itself and the belt, as the belt driving roller is tilted to steer the endless belt. Thus, it is possible that the belt cleaning member will reduce in the belt cleaning performance (CLN performance). Thus, it is desired to realize a structural arrangement for an endless belt driving system that does not require an endless belt driving roller to be changed in angle in order to reduce the force which causes the endless belt to laterally shift.

SUMMARY OF THE INVENTION

Thus, the primary object of the present invention is to provide an image forming apparatus, which is structured neither to steer its belt driving roller nor change the belt driving roller in angle, and yet, is significantly smaller in the amount of the force which acts in the direction to cause the belt to laterally shift than any image forming apparatus in accordance with the prior art.

According to an aspect of the present invention, there is provided an image forming apparatus comprising a main assembly; an intermediary transfer unit including an endless intermediary transfer belt, a plurality of rollers including a driving roller for applying a driving force to said intermediary transfer belt and stretching said intermediary transfer belt, and an intermediary transfer frame integrally supporting said rollers; a main assembly rail member, fixed to said main assembly, for guiding said intermediary transfer unit, said main assembly rail member regulating and positioning at least said driving roller and a roller around which said intermediary transfer belt is wound with a wrapping angle not less than 90° in a state that intermediary transfer unit is mounted in said main assembly.

According to the present invention, among the multiple rollers by which an endless belt is supported, the rollers (at least belt driving roller) which are greater in the angle of contact (wrapping angle) between themselves and belt are supported by the rails attached to the main assembly of an image forming apparatus so that they are precisely positioned relative to each other by the rails. Thus, the belt supporting rollers, which have significant effect upon the lateral shifting of the endless belt are kept properly and firmly positioned relative to the main assembly of an image forming apparatus. Therefore, the present invention can prevent the problem that because of the distortion of the intermediary transfer belt unit frame, a belt driving roller becomes misaligned. Therefore, it can substantially reduce an image forming apparatus in the amount of the force which acts in the direction to cause the endless belt to laterally shift.

These and other objects, features, and advantages of the present invention will become more apparent upon consideration of the following description of the preferred embodiments of the present invention, taken in conjunction with the accompanying drawings.

BRIEF DESCRIPTION OF THE DRAWINGS

FIGS. 2 (*c*) and 2 (*d*) are external views, one for one, of one of the primary transfer roller holders in this embodiment.

FIG. 3(*c*) is a perspective view of the cam, in this embodiment, for allowing intermediary transfer belt from separating from the photosensitive drums.

DESCRIPTION OF THE PREFERRED EMBODIMENTS

Hereinafter, one of the preferred embodiments of the present invention is described with reference to the appended drawings. The dimension, material, and shape of the structural components of the image forming apparatus in this embodiment, and the positional relationship among the structural components, are not intended to limit the present invention in scope, unless specifically noted. Further, if two or more components in the appended drawings are the same in referential code, they are the same in structure and/or function. Therefore, if one of them is described, the others are not described.

Figure 1:
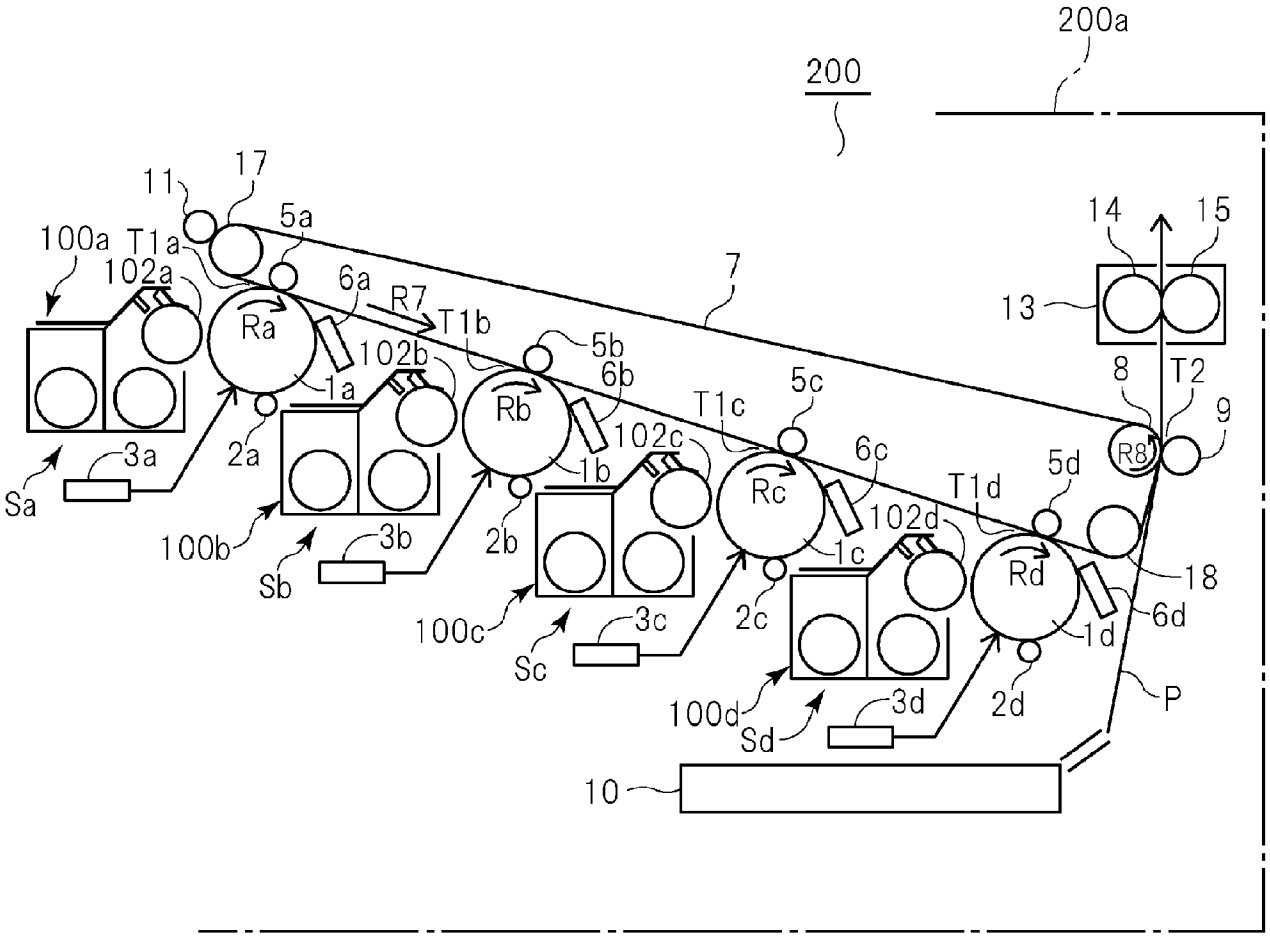
FIG. 1 is a schematic sectional view of a typical image forming apparatus to which the present invention is applicable. It shows the general structure of the apparatus.

FIG. 1 is a schematic sectional view of the image forming apparatus in this embodiment of the present invention, and shows the general structure of the apparatus. Referring to FIG. 1, an image forming apparatus 200 is an example of a full-color image forming apparatus (which has copying function, printing function, and facsimile function). The image forming apparatus 200 has a main assembly 200*a* which has four image formation stations Sa, Sb, Sc and Sd, which are aligned in the listed order, in the direction parallel to the rotational direction (indicated by arrow mark R7 in FIG. 1) of the intermediary transfer belt 7 of the apparatus, with the image forming stations Sa and Sd positioned most upstream and downstream, respectively, in terms of the moving direction of the belt 7.

The image forming stations Sa, Sb, Sc and Sd are structured so that they form yellow, magenta, cyan, and black toner images, respectively. They are provided with electrophotographic photosensitive members (which hereafter are referred to as "photosensitive drums") which are in the form of a drum. Each photosensitive drum is a latent image bearing member of the apparatus.

The image forming apparatus 200 is structured so that its photosensitive drums 1*a*, 1*b*, 1*c* and 1*d* are rotationally driven in the directions indicated by arrow marks Ra, Rb, Rc and Rd, respectively (clockwise direction in FIG. 1). The four image formation stations Sa, Sb, Sc and Sd are provided with primary charging devices 2*a*, 2*b*, 2*c* and 2*d*, respectively, which are charging means, and exposing devices 3*a*, 3*b*, 3*c* and 3*d*, respectively, which are latent image forming means. The charging devices 2*a*, 2*b*, 2*c* and 2*d*, and exposing devices 3*a*, 3*b*, 3*c* and 3*d*, are positioned in the adjacencies of the peripheral surface of the photosensitive drums 1*a*, 1*b*, 1*c* and 1*d*, respectively, with the charging devices 2*a*, 2*b*, 2*c* and 2*d* positioned upstream of the exposing devices 3*a*, 3*b*, 3*c* and 3*d*, in terms of the rotational direction of the corresponding photosensitive drums 1*a*, 1*b*, 1*c* and 1*d*, respectively.

Further, the image formation stations Sa, Sb, Sc and Sd are provided with developing apparatuses 100*a*, 100*b*, 100*c* and 100*d* which are developing means, and primary transfer rollers 5*a*, 5*b*, 5*c* and 5*d* which are the primary transferring means. Each developing device 100 and each primary transfer roller 5 are positioned in the adjacencies of their corresponding photosensitive drum 1. Further, the image forming stations Sa, Sb, Sc and Sd are provided with cleaning blades 6*a*, 6*b*, 6*c* and 6*d*, which are the means for cleaning the photosensitive drums 1*a*, 1*b*, 1*c* and 1*d*, respectively. The cleaning blades 6*a*, 6*b*, 6*c* and 6*d* are positioned in the adjacencies of the peripheral surface of the photosensitive drums 1*a*, 1*b*, 1*c* and 1*d*, respectively.

Further, the image forming apparatus 200 is provided with an endless intermediary transfer belt 7, which is suspended and kept tensioned by the four primary transfer rollers 5*a*-5*d*, idler roller 18, driving roller 8, and tension roller 17, which are positioned in a predesignated positional relationship. While an image is formed by the image forming apparatus 200, the intermediary transfer belt 7 is kept pressed by the primary transfer rollers 5*a*-5*d* from the inward side of the belt 7 in terms of the loop which the belt u forms, in such a manner that the outward surface of the belt 7 remains in contact with each of the photosensitive drums 1*a*, 1*b*, 1*c* and 1*d*.

As the primary transfer rollers 5*a*-5*d* are pressed against the photosensitive drums 1*a*-1*d*, primary transfer nips T1*a*, T1*b*, T1*c* and T1*d* are formed between the intermediary transfer belt 7 and the photosensitive drums 1*a*-1*d*, respectively. The intermediary transfer belt unit 40 is structured so that as the belt driving roller 8 which doubles as the roller for backing up the intermediary transfer belt 7, is rotated in the direction indicated by an arrow mark R8, the intermediary transfer belt 7 rotates in the direction indicated by an arrow mark R7. The rotational speed of the intermediary transfer belt 7 is set to be roughly the same as the rotational speed (process speed) of each of the above described photosensitive drums 1*a*-1*d*.

Further, the image forming apparatus 200 is provided with a secondary transfer roller 9, as an image transferring second means, which is positioned so that it remains in contact with the outward surface of the intermediary transfer belt 7 and opposes the belt driving roller 8 with the presence of the intermediary transfer belt 7 between itself and the belt driving roller 8, forming thereby a secondary transfer nip T2, as the secondary transfer station, between itself and the intermediary transfer belt 7. Further, there is a belt cleaner 11, as a cleaner for cleaning the intermediary transfer belt 7, which is positioned in such a manner that it remains in contact with the outward surface of the intermediary transfer belt 7 and opposes the secondary transfer roller 9, with the presence of the intermediary transfer belt 7 between itself and tension roller 17.

Sheets P of recording medium, which are to be used for image formation are stored in layers in a sheet feeder cassette 10, which is in the bottom portion of the main assembly 200*a* of the image forming apparatus 200. Each sheet P of recording medium is conveyed to the above described secondary transfer nip T2 by a recording medium conveying device, which is made up of a sheet feeder roller, a sheet conveyance roller, a pair of registration rollers, etc (none of which are illustrated in drawings). There is a fixing device 13 on the downstream side of the secondary transfer nip T2 in terms of the direction in which the sheet P of recording medium is conveyed. The fixing device 13 has a fixation roller 14, and a pressure roller 15 which is kept pressed upon the fixation roller 14. Further, there is a delivery tray (unshown) on the downstream side of the fixing device 13.

The process through which a full-color toner image is formed on a sheet P of recording medium by the image forming apparatus 200 which is structured as described above, is as follows: To begin with, an original is read, and image formation signals which reflect magenta, cyan, yellow and black color components of the original are created. Meanwhile the photosensitive drums 1*a*-1*d* are rotationally driven by a photosensitive drum driving motor (unshown) in the direction indicated by the arrow marks Ra, Rb, Rc and Rd, respectively, at a preset process speed, while the photosensitive drums 1*a*-1*d* are uniformly charged across their peripheral surface, by the primary charging devices 2*a*, 2*b*, 2*c* and 2*d*, respectively. Then, the uniformly charged portion of the peripheral surface of each of the photosensitive drums 1*a*-1*d* is exposed by the corresponding exposing device 3*a*, 3*b*, 3*c* or 3*d*, based on the information of the image to be formed. Thus, electrical charge is removed from the exposed points of the uniformly charged portion of each of the photosensitive drums 1*a*-1*d*. Consequently, four electrostatic latent images, which correspond in pattern to the monochromatic magenta, cyan, yellow, and black images, into which the image of the original has been separated, are effected on the peripheral surfaces of the photosensitive drums 1*a*-1*d*, respectively.

The electrostatic latent images on the photosensitive drums 1*a*-1*d* are developed into visible images, more specifically, yellow, magenta, cyan and black images formed of yellow, magenta, cyan and black toners, by the development sleeves 102*a*, 102*b*, 102*c* and 102*d* of the developing devices 100*a*-100*d*, respectively. These four monochromatic toner image, different in color, are sequentially transferred (primary transfer) onto the outward surface of the intermediary transfer belt 7 by the primary transfer rollers 5*a*, 5*b*, 5*c* and 5*d*, in the primary transfer nips T1*a*, T1*b*, T1*c* and T1*d*, respectively. Consequently, the four monochromatic toner images, different in color, are placed in layers on the intermediary transfer belt 7. The toner remaining on the peripheral surface of each of the photosensitive drums 1*a*-1*d* is recovered into a recovery toner box (unshown) by a photosensitive drum cleaning means.

The four toner images, different in color, layered on the intermediary transfer belt 7 as described above are transferred (secondary transfer) onto a sheet P of recording medium. More concretely, as one of the sheets P of recording medium in the sheet feeder cassette 10 is moved out of the cassette 10 by a recording medium feeding/conveying device, it is conveyed further by a pair of registration rollers (unshown) to the secondary transfer nip T2 with such a timing that the sheet P arrives to the secondary transfer nip T2 at the same time as the toner images on the intermediary transfer belt 7. Then, the toner images on the intermediary transfer belt 7 are transferred together (secondary transfer) onto the sheet P by the secondary transfer roller 9.

After the secondary transfer of the four toner images, different in color, onto the sheet P of recording medium, the sheet P is conveyed to the fixing device 13, in which the sheet P and the toner images thereon are subjected to heat and pressure. Consequently, the toner images become fixed to the surface of the sheet P. After the fixation of the toner images to the sheet P, the sheet P is discharged into the delivery tray (unshown), ending the operation for forming a full-color image on one side (surface) of the sheet P.

[General Description of Intermediary Transfer Unit]

Figure 2:
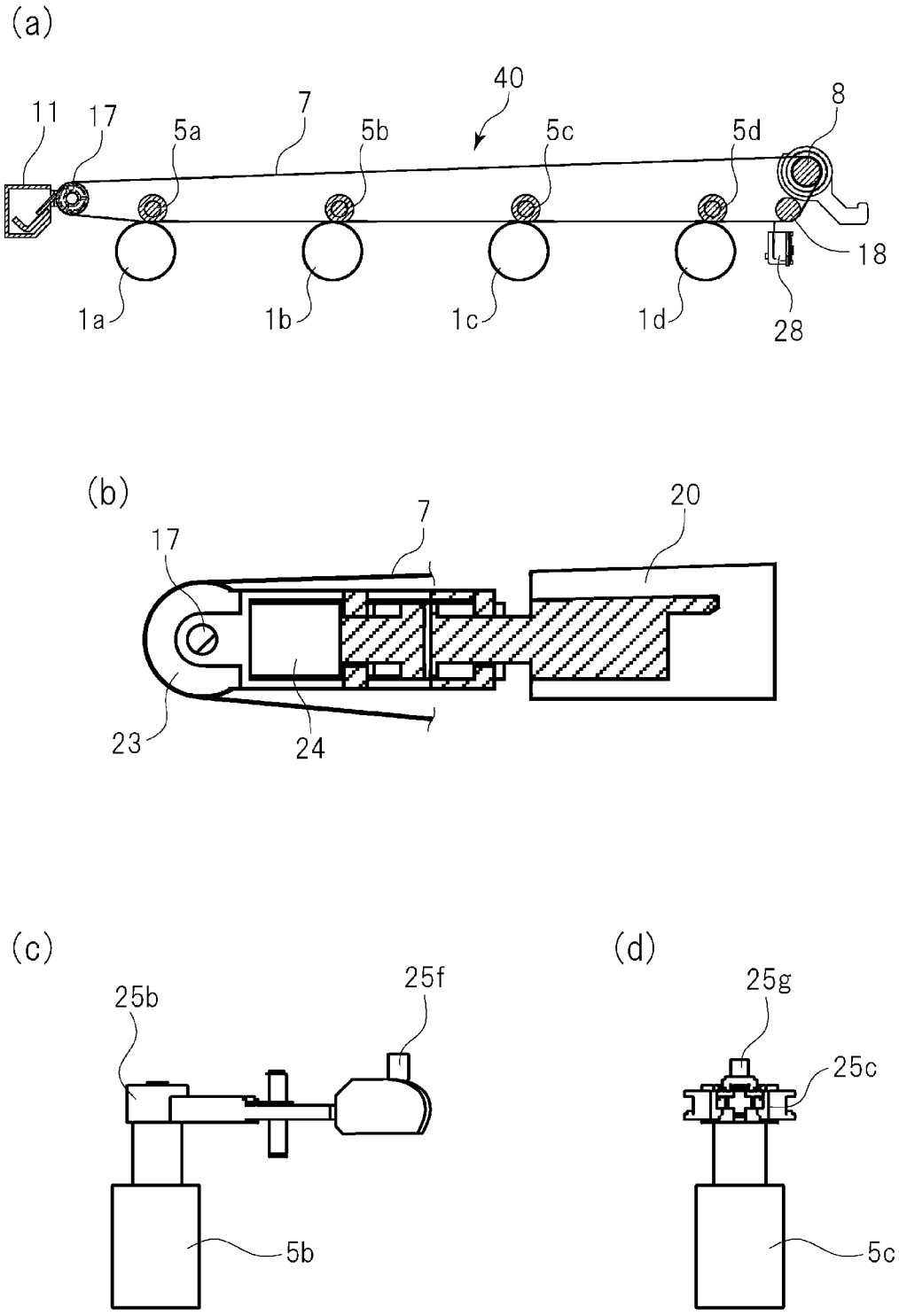
FIG. 2(*a*) is a schematic sectional view of the intermediary transfer unit in one of the embodiments of the present invention, when the image forming apparatus is being used for image formation, and FIG. 2(*b*) is a schematic sectional view of the tension roller portion of the intermediary transfer unit, shown in FIG. 2(*a*).

Next, referring to FIGS. 2(*a*)-(*d*), the intermediary transfer unit 40 is described. FIG. 2(*a*) is a schematic sectional view of the intermediary transfer unit 40 in this embodiment of the present invention, when the image forming apparatus is being used for image formation, and FIG. 2(*b*) is a schematic sectional view of the tension roller portion of the intermediary transfer unit 40, shown in FIG. 2(*a*). FIGS. 2(*c*) and 2(*d*) are external views, one for one, of one of the primary transfer roller holders in this embodiment.

First, referring to FIG. 2(*a*), the overall structure of the intermediary transfer unit 40 is described. The intermediary transfer unit 40 has the intermediary transfer belt 7, which is endless and is supported and kept tensioned by multiple rollers, including the belt driving roller 8.

Referring also to FIG. 2(*a*), more specifically, in the case of the intermediary transfer unit 40 in this embodiment, the intermediary transfer belt 7 is supported and kept tensioned by three belt supporting/tensioning rollers, more specifically, the driver roller 8 for driving the intermediary transfer belt 7, the idler roller 18 which is rotated by the movement of the intermediary transfer belt 7, and the tension roller 17.

The driver roller 8 is provided with a thin surface layer, which is formed of rubber. It is rotatably supported by a frame 20 (FIG. 6) of the intermediary transfer unit 40, with the placement of a pair of bearings between the lengthwise ends portion of the driver roller 8 and frame 20. The driver roller 8 and the other rollers are all supported by this frame 20 of the intermediary transfer unit 40.

As the intermediary transfer unit 40 is inserted into the apparatus main assembly 200*a*, the driver roller 8, which is supported by the intermediary transfer unit frame 20, is not only supported by the main assembly rails 32, but also, is precisely positioned relative to the apparatus main assembly 200*a* by the main assembly rails 32. The rollers, such as the driver roller 8, which are supported by the main assembly rails 32 and precisely positioned relative to the apparatus main assembly 200*a* by the main assembly rails 32, are such rollers of the intermediary transfer unit 40 that are not less than 90° in the angle of contact between themselves and intermediary transfer belt 7. Here, the "angle of contact" or "wrapping angle" means the angle between the line which connects the center of a given roller and the downstream end of the area of contact between the roller and intermediary transfer belt 7, in terms of the rotational direction of the roller, and the line which connects the center of the given roller and the upstream end of the area of contact between the roller and intermediary transfer belt 7. The rollers which support and keep tensioned the intermediary transfer belt 7 and are greater than 90° in the angle of contact between themselves and intermediary transfer belt 7 include not only the abovementioned driver roller 8, but also, the tension roller 17 for providing the intermediary transfer belt 7 with a preset amount of tension.

Figure 3:
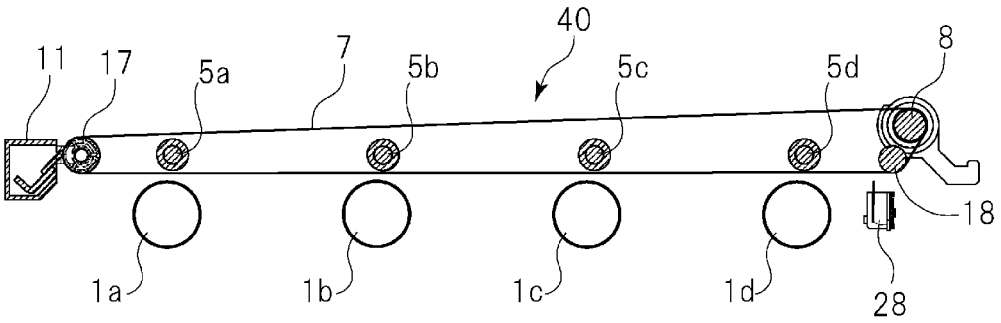
FIGS. 3(*a*) and 3(*b*) are schematic sectional views of the intermediary transfer unit of the image forming apparatus shown in FIG. 1, when the intermediary transfer belt is not in contact with the photosensitive drums, and when the intermediary transfer belt is in contact with the photosensitive drums, respectively.
Figure 3:
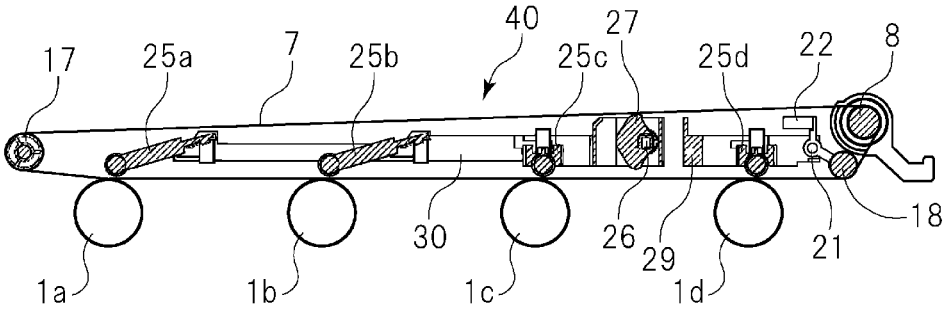
Figure 3:
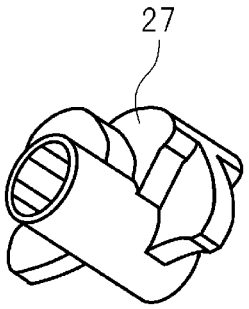

The above-mentioned idler roller 18 is rotatably supported by a pair of idler roller bearings 21 (FIG. 3(*b*)) which are supported by the intermediary transfer unit frame 20 in such a manner that they can be pivotally moved about the pivots by which they are attached to the intermediary transfer unit frame 20. Further, the intermediary transfer unit 40 is provided with a registration patch sensor 28 for adjusting the image forming apparatus 200 in color and/or density, which is positioned so that it opposes the idler roller 18.

Figure 6:
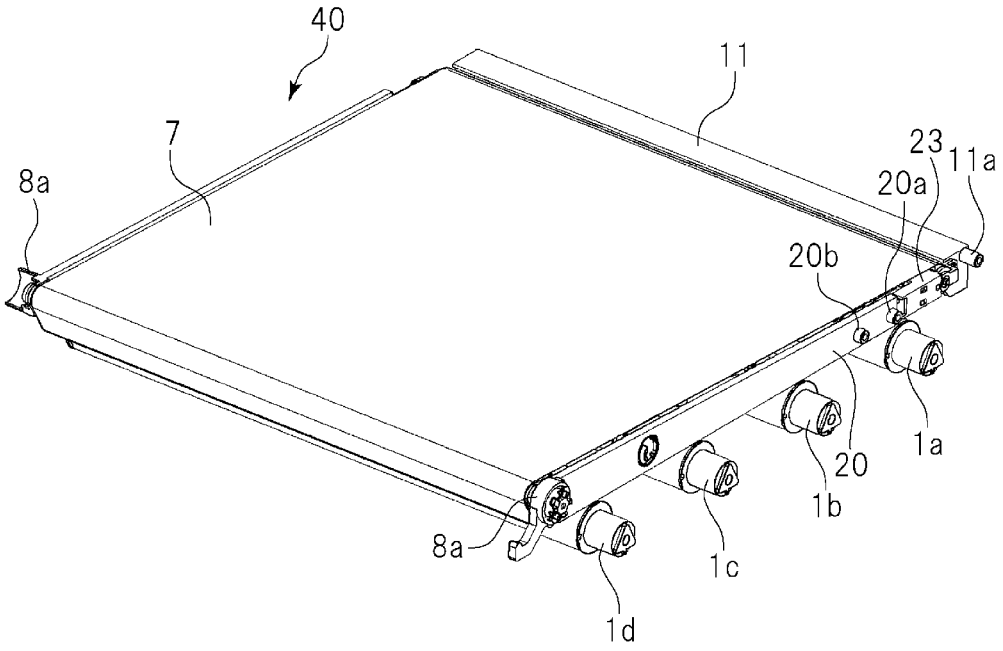
FIG. 6 is an external perspective view of the intermediary transfer unit in this embodiment.

Next, referring to FIG. 2(*b*), the tension roller 17 is rotatably supported by a pair of tension roller bearings 23, by its lengthwise ends, with the placement of a pair of belt tension springs 24 between each tension bearing 23 and intermediary transfer unit frame 20 (FIG. 6, as well as FIG. 2(*b*)), in the state of being compressed. The tension belt springs 24 are compression springs such as coil springs.

The tension roller bearings 23 are held to the intermediary transfer unit frame 20 in such a manner that they are allowed to slide relative to the intermediary transfer unit frame 20 in the direction parallel to the direction in which the belt tension springs are compressed or allowed to expand, providing thereby the intermediary transfer belt 7 with the preset amount of tension. Further, the tension roller bearings 23 are held to the intermediary transfer unit frame 20 in such a manner that they are allowed to move in the vertical direction by a small distance. Thus, the tension roller 17 is allowed to vertically moved relative to the intermediary transfer unit frame 20, even though they are held to the intermediary transfer unit frame 20.

The primary transfer rollers 5*a*-5*d* are positioned so that they oppose the photosensitive drums 1*a*-1*d*, respectively. More specifically, referring to FIGS. 2(*c*) and 2(*d*), the primary transfer rollers 5*a*-5*d* are supported by the primary transfer roller holders 25*a*-25*d* (FIG. 3(*b*), as well as FIGS. 2(*c*) and 2(*d*)) in such a manner that they are allowed to pivotally move or move in a straight line to be pressed against, or to be moved away from, the photosensitive drums 1*a*-1*d*, respectively.

The intermediary transfer belt 7 in this embodiment is formed of PEEK (Polyether-ether-Ketone), and is 91.9 mm in circumference, 346.0 mm in width, and 48 μm in thickness, for example. The material for the intermediary transfer belt 7 does not need to be limited to PEEK. For example, polyimide, polycarbonate, PVDF, ETFE, PTFE, and the like also can be listed as desirable substances as the material for the intermediary transfer belt 7.

The intermediary transfer belt 7 is provided with a pair of ribs, which are on the inward surface of the intermediary transfer belt 7, being position in the adjacencies of the lateral edges of the intermediary transfer belt 7, and therefore, being parallel to the recording medium conveyance direction. Each rib in this embodiment is perpendicular to the inward surface of the intermediary transfer belt 7, and extends in the direction parallel to the moving direction of the intermediary transfer belt 7 across the entirety of the intermediary transfer belt 7. It is made of urethane, and is 3 mm in width, and 1.2 mm in height; it is a protrusion which looks like a long, narrow, and endless belt.

First, referring to FIGS. 3(*a*) and 3(*b*), the mechanical structure for moving the primary transfer rollers 5*a*-5*d* from the photosensitive drums 1*a*-1*d*, respectively, is described. FIGS. 3(*a*) and 3(*b*) are schematic sectional views of the intermediary transfer unit 40 in this embodiment, when the intermediary transfer belt is not in contact with the photosensitive drums, and when the intermediary transfer belt is in contact with the photosensitive drums, respectively.

Referring to FIG. 3(*a*), the intermediary transfer unit 40 is structured so that when the image forming apparatus 200 is used for outputting a black monochromatic image, or when the intermediary transfer unit 40 needs to be installed or uninstalled, the primary transfer rollers 5*a*-5*d* can be moved away from the intermediary transfer belt 7 so that the intermediary transfer belt 7 is allowed to separate from the photosensitive drums 1*a*-1*d*. When the primary transfer rollers 5*a*-5*d* move away from the photosensitive drums 1*a*, 1*b*, 1*c* and 1*d*, the idler roller 18 also moves in the same direction as the primary transfer rollers 5*a*-5*d*. This structural arrangement is also effective to extend the lives of the primary transfer rollers 5*a*-5*d*, and to prevent the intermediary transfer belt 7 from being scarred during the installation or uninstallation of the intermediary transfer unit 40.

Next, referring to FIGS. 3(*a*) and 3(*b*), the primary transfer rollers 5*a*-5*d* are held to the intermediary transfer unit frame 20 (FIG. 6), with the placement of the primary transfer roller holders 25*a*~25*d* between the primary transfer rollers 5*a*-5*d* and intermediary transfer unit frame 20, in such a manner that the primary transfer rollers 5*a*-5*d* can be pressed against, or moved away from, the photosensitive drums 1*a*-1*d*, respectively. As for the idler roller 18, it is held to the intermediary transfer unit frame 20, with the placement of the idler roller bearings 21 between itself and the intermediary transfer unit frame 20, in such a manner that it can be moved toward, or away from, the photosensitive drum 1*d*.

Figure 4:
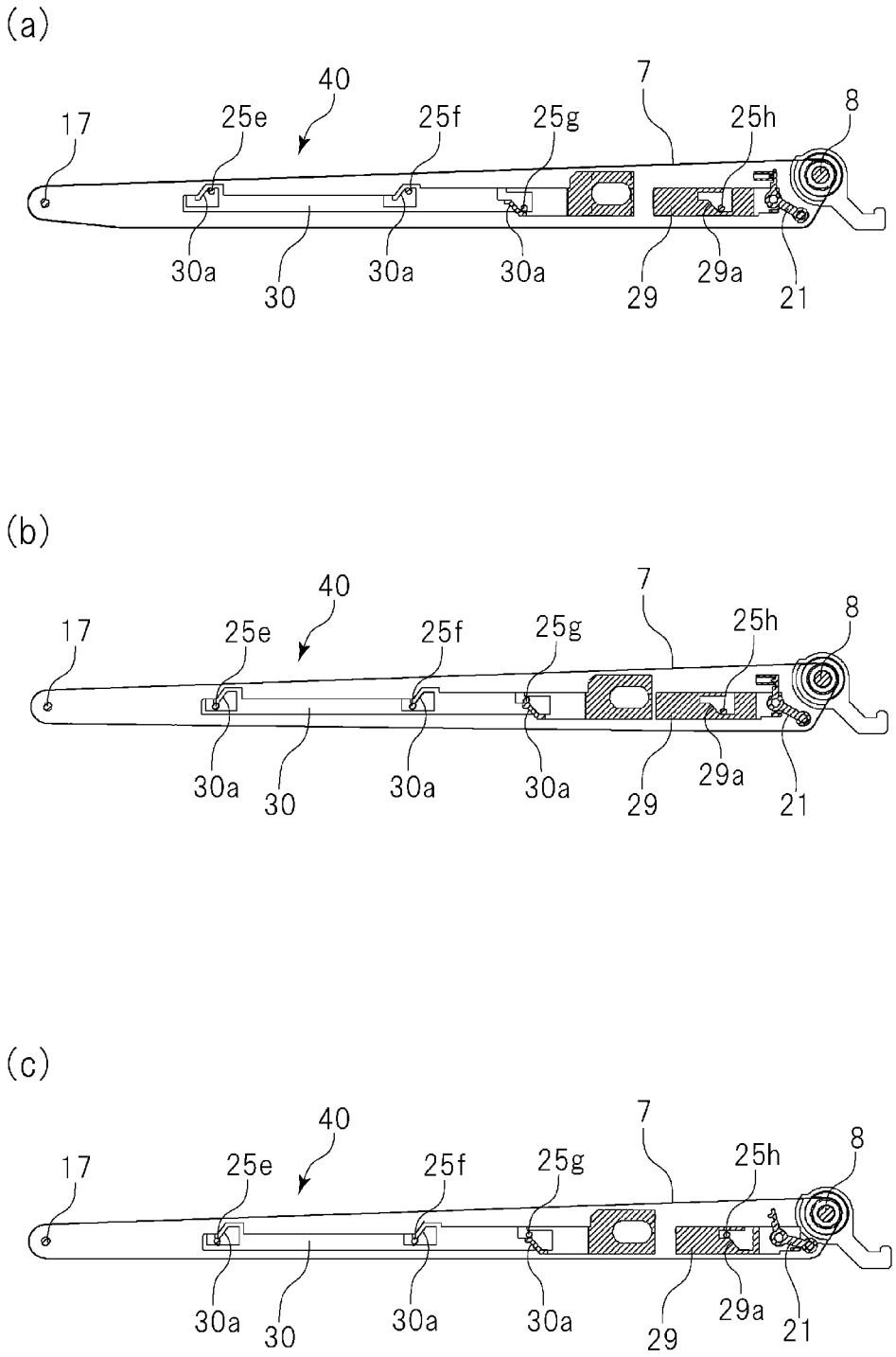
FIGS. 4(*a*)-4(*c*) are drawings for describing the operation for separating the intermediary transfer rollers from the corresponding photosensitive drums.
Figure 5:
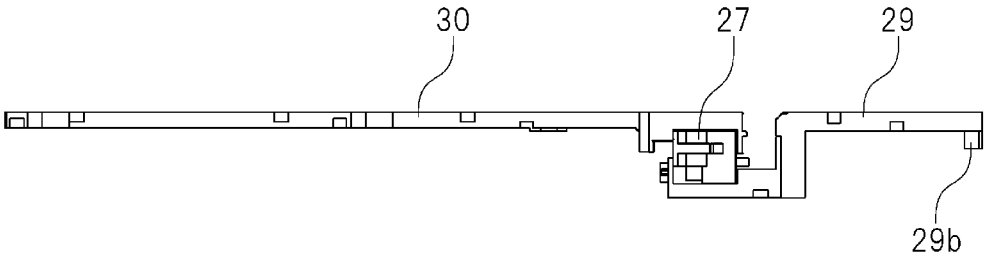
FIGS. 5(*a*)-5(*c*) also are drawings for describing the operation for separating the primary transfer rollers from the corresponding photosensitive drums.
Figure 5:
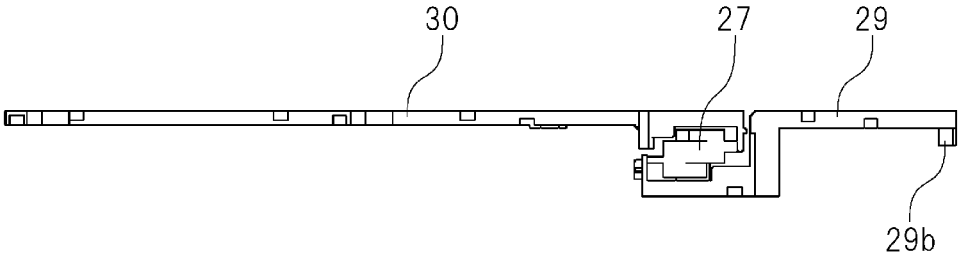
Figure 5:
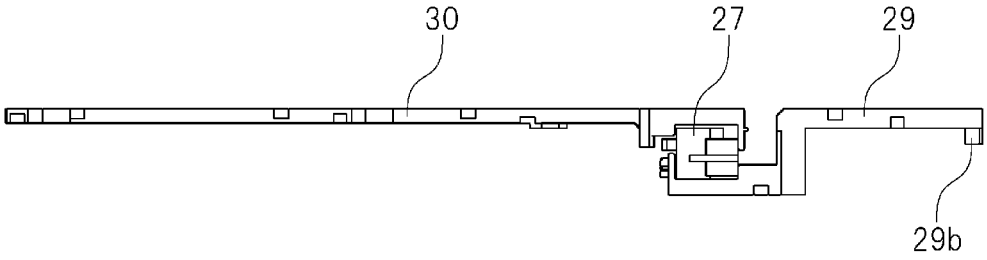

Next, referring to FIGS. 3(*b*) and 3(*c*), FIGS. 4(*a*)-4(*c*), and FIGS. 5(*a*)-5(*c*), the operation for moving the primary transfer rollers 5*a*-5*d* away from the intermediary transfer belt 7 is described. FIG. 3(*c*) is an external perspective view of a cam 27 for moving the primary transfer rollers 5*a*-5*d* away from the intermediary transfer belt 7. FIGS. 4(*a*)-4(*c*) are side views of the intermediary transfer unit 40, which are for describing the operation for moving the primary transfer rollers 5*a*-5*d* away from the intermediary transfer belt 7. FIGS. 5(*a*)-5(*c*) are plan views of the intermediary transfer unit 40, which is for describing the operation for moving the primary transfer rollers 5*a*-5*d* away from the intermediary transfer belt 7.

Referring to FIG. 3(*b*), the shaft 26 for the cams 27 is rotatably supported by the intermediary transfer unit frame 20 (FIG. 6), being positioned in parallel to the photosensitive drums 1*a*-1*d* and rollers 5*a*-5*d*, 8, 17 and 18. The pair of the aforementioned cams 27 are attached to the lengthwise portions of the shaft 26, one for one, which are on the inward side of the intermediary transfer unit frame 20. As driving force is inputted into the shaft 26 for the cams 27 from an unshown driving force source, the cams 27 rotate with the shaft 26. The intermediary transfer unit 40 is also provided with a pair of Bk sliders 29 and a pair of CL sliders 30, which are positioned so that they come into contact with the cams 27. Thus, as the cams 27 rotate, the pair of Bk sliders 29 and the pair of CL sliders 30 are moved by the cams 27 in the left and right directions, respectively, in FIG. 3.

Referring again to FIGS. 2(*c*) and 2(*d*) (along with FIGS. 3 and 4), the intermediary transfer roller holders 25*a*-25*d* are provided with protrusions 25*e*-25*h*, respectively. Incidentally, FIGS. 2(*c*) and 2(*d*) show only the protrusions 25*f* and 25*g*, which correspond to the intermediary transfer roller holders 25*b* and 25*c*, respectively.

Next, referring to FIGS. 4(*a*)-4(*c*), the Bk slider 29 and Cl slider 30 are moved in the left and right directions, respectively, while the protrusions 25*e*-25*h* are kept in contact with the slanted edges 29*a* and 30*a* of the sliders 29 and 30, respectively. Thus, the primary transfer rollers 5*a*-5*d* are moved away from the portions of the intermediary transfer belt 7, which are in contact with the photosensitive drums 1*a*-1*d*, respectively.

As described above, the idler roller 18 is rotatably supported by the pair of idler roller bearings 21 which are supported by the intermediary transfer unit frame 20 so that the bearings 21 are allowed to pivotally move about the axles attached to the intermediary transfer unit frame 20. Each idler bearing 21 is kept pressed toward the intermediary transfer belt 7 by an idler roller spring 22 (FIG. 3(*b*)). Thus, it is kept in contact with the main assembly rail 32 (FIG. 7(*b*)) solidly attached to the apparatus main assembly 200*a* shown in FIG. 1; it is accurately positioned relative to the apparatus main assembly 200*a* by being under the pressure from the spring 22. The main assembly rail 32 is solidly attached to the apparatus main assembly 200*a*, and guides the intermediary transfer unit 40 when the intermediary transfer unit 40 is installed into, or uninstalled from, the apparatus main assembly 200*a*.

As the Bk slider 29 is moved, its portion 29*b* (FIG. 5) pushes the idler roller bearings 21 in the opposite direction from the intermediary transfer belt 7. Thus, the idler roller 18 is moved in the opposite direction from the intermediary transfer belt 7.

The operation for separating the primary transfer rollers 5*a*-5*d* from the intermediary transfer belt 7 can be divided into three stages, which puts the intermediary transfer unit 40 (image forming apparatus 200) in three modes, one for one. FIGS. 4(*a*)-4(*c*) show the intermediary transfer unit 40 when the intermediary transfer unit 40 is in the three modes, respectively.

FIG. 4(*a*) shows the intermediary transfer unit 40 when the intermediary transfer unit 40 is in the CL mode, in which all the primary transfer rollers 5*a*-5*d*, the movement of which relative to the photosensitive drums 1*a*-1*d* (intermediary transfer belt 7), respectively, is controlled by the protrusions 25*e*-25*h*, are kept pressed against the photosensitive drums 1*a*-1*d* (intermediary transfer belt 7). FIG. 4(*b*) shows the intermediary transfer unit 40 when the intermediary transfer unit 40 is in the Bk mode, in which only the primary transfer roller 5*d* ("Bk" stands for "black"), the movement of which relative to the photosensitive drum 1*d* (intermediary transfer belt 7) is controlled by the protrusion 25*h*, is kept pressed against the corresponding photosensitive drum (photosensitive drum 1*a*). FIG. 4(*c*) shows the intermediary transfer unit 40 when the intermediary transfer unit 40 is in the full separation mode, in which all the primary transfer rollers 5*a*-5*d* are separated from the photosensitive drums 1*a*-1*d* (none of the primary transfer rollers 5*a*-5*d* is kept pressed against the photosensitive drums 1*a*-1*d*), respectively.

FIGS. 5(*a*), 5(*b*) and 5(*c*) show the positional relationships among the cam 27, Bk slider 29, and CL slider 30, which correspond to the CL mode, Bk mode, and full-separation mode, respectively. FIGS. 4(*a*)-4(*c*) and FIGS. 5(*a*)-5(*c*) correspond to the CL mode, Bk mode, and full-separation mode, which are different by 120° in the angle of the cam 27.

The cam 27 (referring to FIG. 3(*c*) as well) has a surface which corresponds to the Bk slider, and a surface which corresponds to the CL slider. It is structured so that each time it is rotated by 120°, it causes the Bk slider and CL slider to differently move.

In FIGS. 4(*a*) and 5(*a*), the Bk slider 29 is in its leftmost position, and the CL slider is in its leftmost position. In FIGS. 4(*b*) and 5(*b*), the Bk slider is in its leftmost position, whereas the CL slider is in its rightmost position. In FIGS. 4(*c*) and 5(*c*), the Bk slider is in this rightmost position, and the CL slider is in its rightmost position.

In this embodiment, the operation for separating the primary transfer rollers 5*a*-5*d* from the intermediary transfer belt 7 is carried out by coordinating the moving direction of the Bk slider, moving direction of the CL slider, the shapes of the slanted surfaces 29*a* and 30*a* of the Bk and CL sliders 29 and 30, respectively, and shape of the portions 29*b* and 30*b* of the Bk and CL sliders 29 and 30, respectively.

The primary transfer rollers 5*a*-5*d* and idler roller 18 are precisely positioned relative to the units (unshown unit for supporting photosensitive drums 1*a*~1*d*, for example) other than the intermediary transfer unit 40, registration patch detection sensor 28 (FIG. 2(*a*)), etc.

[Structural Arrangement for Positioning Rollers]

Figure 7:
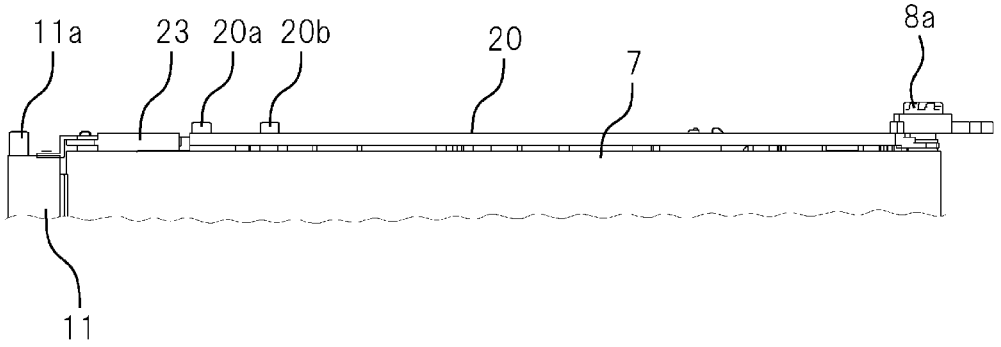
FIG. 7(*a*) is a plan view of the intermediary transfer unit in this embodiment, and FIG. 7(*b*) is a detailed view of one of the rails of the main assembly of the image forming apparatus in this embodiment, which is for supporting and positioning the belt supporting rollers.
Figure 7:
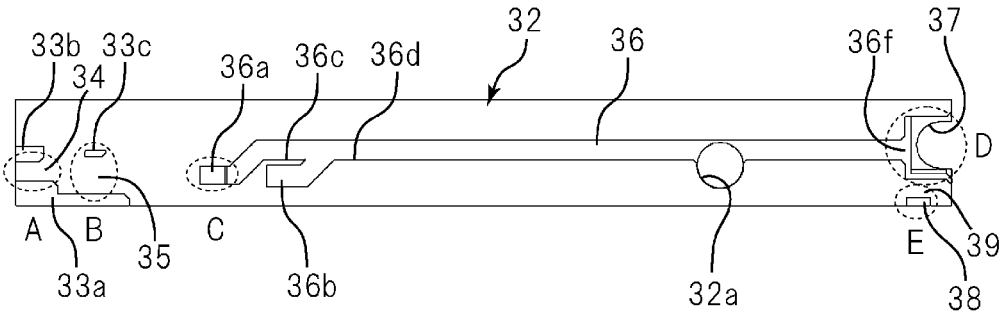
Figure 8:
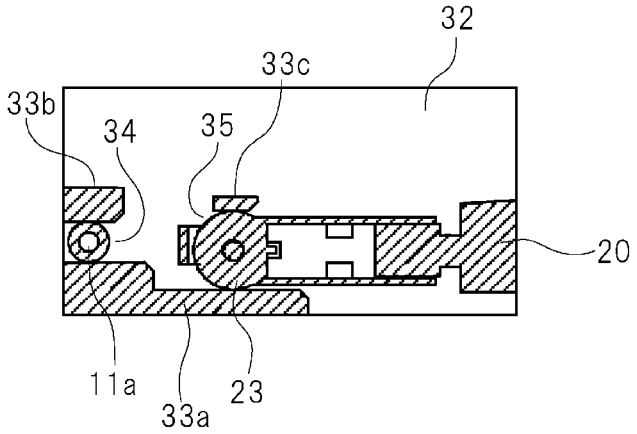
FIG. 8(*a*) is a schematic sectional view of the primary transfer roller positioning portion of the image forming apparatus in this embodiment, and FIG. 8(*b*) also is a schematic sectional view of the primary transfer roller positioning portion of the image forming apparatus.
Figure 8:
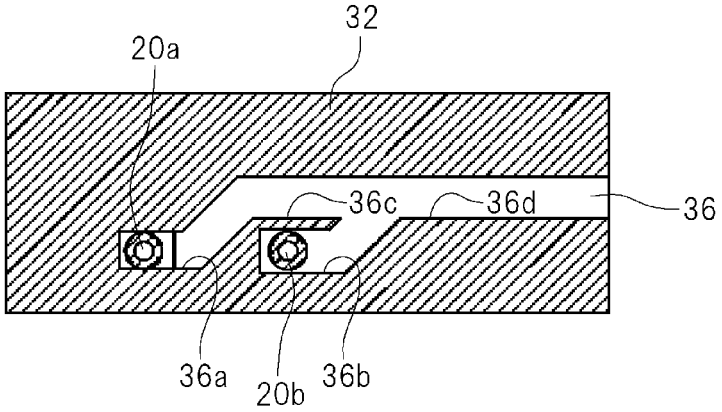
Figure 9:
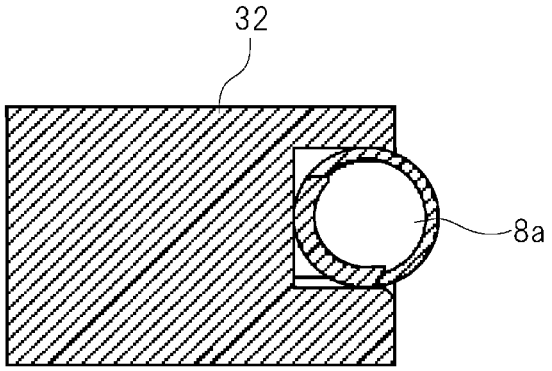
FIG. 9(*a*) is a schematic sectional view of the driver roller positioning portion of the image forming apparatus in this embodiment, and FIG. 9(*b*) also is a schematic sectional view of the driver roller positioning portion of the image forming apparatus.
Figure 9:
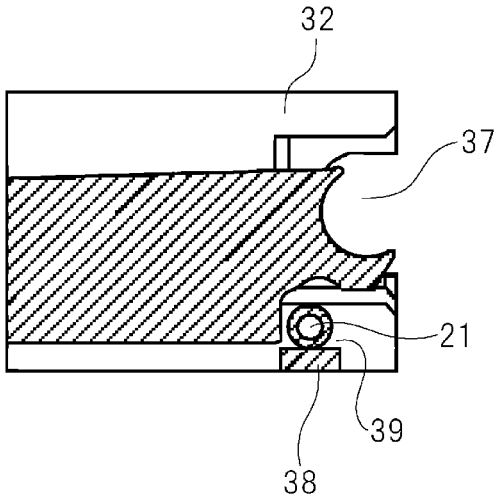
Figure 10:
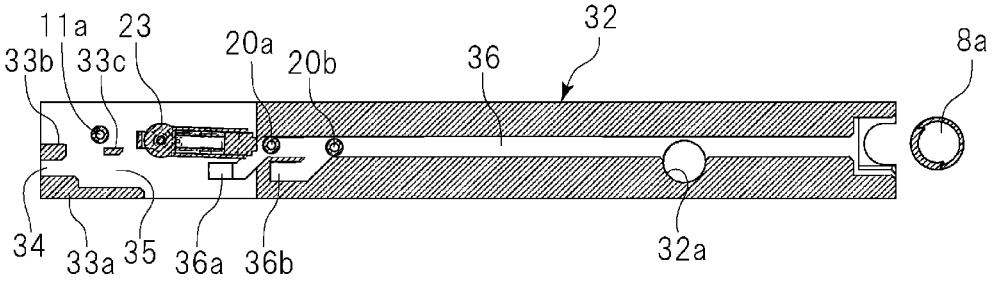
FIGS. 10(*a*) and 10(*b*) are schematic sectional views of the intermediary transfer belt unit, in this embodiment, and its adjacencies when the unit is being inserted into, or removed from, the main assembly of the image forming apparatus.
Figure 10:
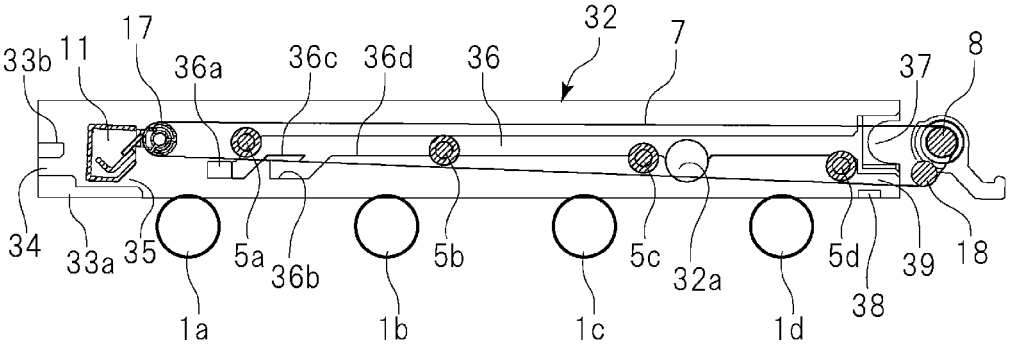

Next, the structural arrangement for precisely positioning the rollers of the intermediary transfer unit 40 is described. FIG. 6 is an external perspective view of the intermediary transfer unit 40 in this embodiment. FIG. 7(*a*) is a plan view of the intermediary transfer unit 40 in this embodiment, and FIG. 7(*b*) is a detailed plan view of one of the pair of main assembly rails 32 in this embodiment. FIGS. 8(*a*) and 8(*b*) are sectional views of the roller positioning portions of the main assembly rail 32 in this embodiment. FIGS. 9(*a*) and 9(*b*) are sectional views of the roller positioning portion of the main assembly rail 32 in this embodiment. FIGS. 10(*a*) and 10(*b*) are sectional views of the combination of the main assembly rail 32 and intermediary transfer unit 40 in this embodiment, when the intermediary transfer unit 40 is being inserted into, or removed from, the apparatus main assembly 200*a*.

Referring to FIG. 6, the frame 20 of the intermediary transfer unit 40 is precisely positioned relative to the main assembly rail 32 (FIG. 7(*b*)), by the driver roller positioning portion 8*a* of the driver roller 8, and rotation control bosses 20*a* and 20*b* of the intermediary transfer unit frame 20. The intermediary transfer unit frame 20 is provided with a pair of the control bosses, which are at the lengthwise ends of the intermediary transfer unit frame 20, one for one. The driver roller positioning portions 8*a* and 8*b* of the driver roller 8 are supported by the pair of main assembly rails 32 and 32 (unshown in FIG. 6), one for one, solidly attached to the apparatus main assembly 200*a*.

The tension roller 17 is precisely positioned relative to the apparatus main assembly 200*a* by the pair of tension roller bearings 23, the vertical movement of which is regulated by the protrusions 33*a* and 33*c* (FIG. 8(*a*)) of the main assembly rail 32. Next, referring to FIG. 6, the intermediary transfer unit 40 is provided with the pair of the tension roller bearings 23, which are located at the lengthwise ends of the intermediary transfer unit 40, and the tension roller 17 is supported by these tension roller bearings 23 and 23, by its lengthwise end portions.

The idler roller 18 is one of the intermediary transfer belt supporting rollers, which the registration patch detection sensor 28 (FIG. 3(*a*)) opposes. In order for the registration patch detection sensor 28 to accurately detect the registration patch, the sensor 28 is required to be highly precisely positioned in terms of the distance between itself and intermediary transfer belt 7. In this embodiment, therefore, each idler roller bearing 21 (FIGS. 3 and 4) is placed in contact with the corresponding main assembly rail 32 (FIG. 7(*b*)) to precisely position the registration patch detection sensor 28 relative to the main assembly rail 32.

The belt cleaner 11 is regulated in the angle of its blade relative to the intermediary transfer belt 7 and its distance, while remaining supported by the pair of tension rollers 23 and 23 located at the lengthwise ends of the intermediary transfer unit 40. Further, the belt cleaner 11 is positioned relative to the intermediary transfer belt 7 in such a manner that the vertical movement of its belt cleaner positioning portions 11*a* and 11*b* is regulated by the protrusions 33*a* and 33*b* (FIG. 8(*a*)), with which each of the main assembly rails 32 is provided, being thereby kept precisely positioned relative to the intermediary transfer belt 7.

The intermediary transfer unit frame 20 and main assembly rail 32 are long and narrow members. Their lengthwise ends are shaped so that one of their lengthwise ends can support the driver roller 8, and the other end can support the tension roller 17. The intermediary transfer unit frame 20 is supported by the main assembly rail 32. More specifically, it is inserted into the apparatus main assembly 200*a* so that it fits into the groove of each of the main assembly rails 32 from one of the lengthwise ends of the main assembly rail 32 while supporting the driver roller 8 and tension roller 17 by its lengthwise ends, one for one. Then, it is inserted into the apparatus main assembly 200*a* while being guided by the main assembly rails 32.

It is from the right side of the apparatus main assembly 200*a* in FIG. 1 that the intermediary transfer unit 40 is inserted into, or removed from, the apparatus main assembly 200*a*. Therefore, when the intermediary transfer unit 40 is installed into, or removed from the apparatus main assembly 200*a*, it is from its belt cleaner side that it is inserted into the apparatus main assembly 200*a*. Thus, the relationship among the portions of the various components, by which the various portions are precisely positioned, is as shown in FIG. 7(*a*): positioning portion 11*a*=tension roller bearing 23<rotation control portion 20*a*<positioning portion 8*a*.

By varying various components of the apparatus main assembly 200*a* and intermediary transfer unit 40 in position, in terms of the direction parallel to the lengthwise direction of the main assembly rail 32, the various components can all be precisely positioned by the main assembly rail 32.

That is, the main assembly rail 32 shown in FIG. 7(*b*) is one of the pair of the main assembly rails 32, which are solidly attached to the front and rear plates, one for one, of the main frame of the apparatus main assembly 200*a* (FIG. 1), and which correspond one for one to the lengthwise ends of the intermediary transfer unit 40 which is inserted into the apparatus main assembly 200*a*. The positional relationship among the above-described positioning portions of the various components are as follows:

That is, as the intermediary transfer unit 40 is inserted into the apparatus main assembly 200*a* in such an attitude that the belt cleaner positioning portion 11*a* of the belt cleaner 11 becomes the first portion of the intermediary transfer unit 40 to enter the apparatus main assembly 200*a* through the entrance 34 for the belt cleaner positioning portion 11*a*, the belt cleaner positioning portion 11*a* is precisely positioned by the protrusions 33*a* and 33*b* (FIG. 8(*a*)), with which the deepest end portion A of the main assembly rail 32 is provided. Further, the bearing 23 for the tension roller 17 is introduced into the tension roller positioning slot through the entrance 35, and precisely positioned relative to the main assembly rail 32 by the protrusions 33*a* and 33*b*, with which the portion B of the main assembly rail 32 is provided (FIG. 8(*a*)).

Further, the bosses 20*a* and 20*b* of the intermediary transfer unit frame 20, which are for preventing the intermediary transfer unit 40 from rotationally moving are guided into the slanted portions of the grooves 36*a* and 36*b*, with which the portion C of the main assembly rail 32 is provided, along the edges of the slanted portions, and are precisely positioned relative to the main assembly rail 32 (that is, apparatus main assembly 200*a*) (FIG. 8(*b*)). The portion of the main assembly rail 32, which makes up the top wall of the groove 36*b*, functions as the protrusion 36*c* which regulates the boss 20*b* in coordination with the groove 36*b*. Further, the main assembly rail 32 is provided with a guiding portion 36*d* for guiding the rotation control bosses 20*a* and 20*b* into the grooves 36*a* and 36*b*, respectively. The guiding portion 36*d* is on the right-hand side of the protrusion 36*c* (right-hand side in FIG. 8(*b*)).

Further, the trailing end portion D of the main assembly rail 32, in terms of the direction in which the intermediary transfer unit 40 is inserted into the apparatus main assembly 200*a*, is provided with a recess 37, with which the driver roller positioning portion 8*a* of the driver roller 8 is placed in contact to precisely position the driver roller 8. As the driver roller positioning portion 8*a* is placed in contact with the edge of the recess 37 of the main assembly rail 32, it is pressed by an unshown pressing mechanism in the diagonally upward direction, being thereby precisely positioned by being placed in contact with the main assembly rail 32 at three points.

Further, the portion E of the main assembly rail 32 is provided with a protrusion 38, which is below the recess 37. Thus, as the intermediary transfer unit 40 is inserted into the apparatus main assembly 200*a*, the bearing 21 of the idler roller 18 fits into the gap between the protrusion 38 and its opposing wall, whereby it is precisely positioned relative to main assembly rail 32.

Further, the main assembly rail 32 is provided with a groove 36, which extends in the lengthwise direction of the main assembly rail 32. The right-hand end portion (FIG. 7(*b*)) of the groove 36 is provided with a portion 36*f* through which the cleaner positioning portion 11*a*, rotation control bosses 20*a* and 20*b*, etc., are put in the listed order, when the intermediary transfer unit 40 is inserted into the apparatus main assembly 200*a*. The left end portion (FIG. 7(*a*)) of the groove 36 has the above described branches 36*a* and 36*b*, protrusion 36*c*, and guiding portion 36*d* of the groove 36.

Further, the main assembly rail 32 is provided with a through hole 32*a*, through which the shaft 26 (FIG. 3(*b*)), into which the force for rotating the cam 27 to separate the primary transfer rollers 5*a*-5*d* from the intermediary transfer belt 7 is inputted, is put. The hole 32*a* is parallel to the front-to-rear direction of FIG. 7(*a*). It is near the entrance portion 36*f* of the guiding groove 36. The above-described boss 20*b* is for preventing the rotation control boss 20*a* from falling into the hole 32*a* when the intermediary transfer unit 40 is inserted into the apparatus main assembly 200*a* along the main assembly rails 32.

FIG. 9(*b*) shows how the idler roller positioning portion of the idler roller 18 is precisely positioned at the portion E of the main assembly rail 32 shown in FIG. 7(*b*). Referring to FIG. 9(*b*), the bearing 21 of the idler roller 18 is precisely positioned relative to the main assembly rail 32 (hence, apparatus main assembly 200*a*) by being pressed upon the main assembly rail 32 by the idler roller spring 22 (FIG. 3(*b*)). Thus, it is ensured that the idler roller 18 is properly aligned, and remains aligned, with the other rollers, and also, that the idler roller 18 is precisely positioned relative to the registration patch sensor 28 which is precisely positioned relative to the main assembly rail 32.

Next, referring to FIG. 10(*a*), the positioning of the above-mentioned various rollers, which occurs while the intermediary transfer unit 40 is removed from the apparatus main assembly 200*a*, is described.

If an attempt is made to pull the intermediary transfer unit 40 straight out of the apparatus main assembly 200*a* while the intermediary transfer unit 40 is in the state shown in FIG. 3(*a*), the photosensitive drums 1*a*-1*d*, developing device 100*a*-100*d*, etc. interfere with the belt cleaner 11. Therefore, the intermediary transfer unit 40 has to be pulled out in such an attitude that can prevent the interferences. FIG. 10(*b*) shows the attitude in which the intermediary transfer unit 40 should be kept in order to prevent the interference during the extraction of the intermediary transfer unit 40. That is, as long as the intermediary transfer unit 40 is kept in the attitude shown in FIG. 10(*b*), it can be pulled straight out of the apparatus main assembly 200*a* in the rightward direction of FIG. 10(*b*).

As described above, in this embodiment, at least the driver roller 8 is supported by the main assembly rail 32 solidly attached to the apparatus main assembly 200*a*, and also, is precisely positioned relative to the main assembly 32. That is, the driver roller 8 which is greater in the angle of contact with the intermediary transfer belt 7 than other belt suspending rollers, having therefore greater influence upon the lateral shifting of the intermediary transfer belt 7, is firmly held to the apparatus main assembly 200*a*. Therefore, it is possible to prevent the driver roller 8 from becoming misaligned by the distortion of the intermediary transfer unit frame 20. In other words, this embodiment of the present invention can substantially reduce the amount of force which acts in the direction to laterally shift the intermediary transfer belt 7.

Also in this embodiment, the driver roller 8, tension roller 17, and idler roller, by which the intermediary transfer belt 7 is suspended and kept tensioned, are all precisely positioned relative to the apparatus main assembly 200*a* by the pair of main assembly rails 32 and 32 which are solidly attached to the left and right walls of the apparatus main assembly 200*a* in terms of the direction in which the intermediary transfer unit 40 is inserted into, or pulled out of the apparatus main assembly 200*a*. Therefore, the alignment among the rollers by which the intermediary transfer belt 7 is suspended are not affected by the distortion of the intermediary transfer unit frame 20. Thus, the present invention can reduce the intermediary transfer unit 40 in the amount of misalignment among the belt suspending rollers of the intermediary transfer unit 40.

The greater a given roller among the rollers by which the intermediary transfer roller 7 is suspended, in its angle of contact with the intermediary transfer belt 7, the greater it is in the effect upon the lateral shift of the intermediary transfer belt 7. Therefore, any of the belt suspending rollers, which is greater in its angle of contact with the intermediary transfer belt 7 than 90° is desired to be precisely positioned relative to the main assembly rail 32, even if the roller is not the driver roller 8. In this embodiment, therefore, not only the driver roller 8, but also, the tension roller which also is greater in its angle of contact with the intermediary transfer belt 7 is precisely positioned relative to the main assembly rail 32.

Moreover, in this embodiment, all the rollers by which the intermediary transfer belt 7 is suspended and kept tensioned are precisely positioned by the main assembly rails 32. Therefore, it does not occur that the belt cleaner 11 is reduced in its cleaning performance by the steering of the intermediary transfer belt 7; the performance of the belt cleaner 11 remains as high as possible.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 125678/2012 filed Jun. 1, 2012 which is hereby incorporated by reference.

What is claimed is:

1. An image forming apparatus comprising:

a main body;

a belt unit, mounted to and dismounted from said main body along a first direction of said belt unit, including an endless belt, a plurality of rollers including a first and a second roller configured to stretch said belt, a frame configured to support said rollers, a first engaging portion disposed at an end portion of said first roller with respect to a second direction along a longitudinal direction of said rollers and configured to be fixed to said frame and to position said first roller to said main body, a second engaging portion disposed at an end portion of said second roller with respect to the second direction and configured to be movable to said frame with respect to a third direction intersecting both the first direction and the second direction and to position said second roller to said main body, and a third engaging portion disposed in said frame at a region between said first engaging portion and said second engaging portion as viewed in a direction of axes of said first and second rollers and configured to be fixed to said frame; and a guide member configured to guide said belt unit, disposed in said main body at a position corresponding to said first engaging portion and said second engaging portion, including a first engaged portion engaged with said first engaging portion, a second engaged portion engaged with said second engaging portion, and a third engaging portion engaged with said third engaging portion, in a state that said belt unit is mounted to said main body.

2. An apparatus according to claim 1, wherein said second roller is configured to stretch said belt and apply a tension to said belt.

3. An apparatus according to claim 2, further comprising a tension applying member, provided between said second engaging portion and said frame, configured to apply the tension to said belt, wherein said second engaging portion is supported by said frame through said tension applying member.

4. An apparatus according to claim 1, wherein a wrapping angle of said first roller is not less than 90°, and where the wrapping angle is defined as a central angle from an upstream edge to a downstream edge of a contact region between said first roller and said belt with respect to a rotation direction of said first roller.

5. An apparatus according to claim 1, wherein the first roller is configured to apply a driving force to said belt.

6. An apparatus according to claim 5, wherein said first roller is provided with a surface rubber member.

7. An apparatus according to claim 1, wherein said frame has an elongated configuration having end portions capable of supporting said plurality of rollers, and said guide member has an elongated configuration corresponding to said frame wherein said guide member receives said frame at one end portion and slidingly guides said frame toward the other end portion.

8. An apparatus according to claim 7, wherein said second roller is movable in the first direction with movement thereof in the third direction being limited by engagement between said second engaging portion and said the second engaged portion.

9. An apparatus according to claim 1, further comprising an urging member configured to urge said belt unit to said main body in a state that said belt unit is mounted to said main body, and a locking mechanism configured to maintain the mounted state of said belt unit, wherein the position of at least said first roller is regulated and positioned by said urging member.

10. An apparatus according to claim 1, wherein said frame is provided with a projection, and said guide member is provided with a guiding groove configured to guide said projection when said belt unit is mounted to and dismounted from said main body.

11. An apparatus according to claim 1, wherein a wrapping angle of said second roller is not less than 90°, and where the wrapping angle is defined as a central angle from an upstream edge to a downstream edge of a contact region between said second roller and said belt with respect to a rotation direction of said second roller.

12. An image forming apparatus comprising:

a main body;

a belt unit, mounted to and dismounted from said main body along a first direction of said belt unit, including an endless belt, a plurality of rollers including a first and a second roller configured to stretch said belt, a wrapping angle of each of said rollers being not less than 90°, the wrapping angle being defined as a central angle from an upstream edge to a downstream edge of a contact region between each of said rollers and said belt with respect to a rotation direction of said rollers, a frame configured to support said rollers, a first engaging portion disposed at an end portion of said first roller with respect to a second direction along a longitudinal direction of said rollers and configured to be fixed to said frame and to position said first roller to said main body, and a second engaging portion disposed at an end portion of said second roller with respect to the second direction and configured to be movable to said frame with respect to a third direction intersecting both the first direction and the second direction and to position said second roller to said main body; and a guide member configured to guide said belt unit, disposed in said main body at a position corresponding to said first engaging portion and said second engaging portion, including a first engaged portion engaged with said first engaging portion and a second engaged portion engaged with said second engaging portion in a state that said belt unit is mounted to said main body.

* * * * *